US012103732B2

(12) United States Patent
Lin

(10) Patent No.: US 12,103,732 B2
(45) Date of Patent: Oct. 1, 2024

(54) FOLDING BOX

(71) Applicants: Tsai-Hui Lin, Kaohsiung (TW); SORTNOVA LLC, Cheyenne, WY (US)

(72) Inventor: Tsai-Hui Lin, Kaohsiung (TW)

(73) Assignees: Tsai-Hui Lin, Kaohsiung (TW); SortNova LLC, Cheyenne, WY (US)

( * ) Notice: Subject to any disclaimer, the term of this patent is extended or adjusted under 35 U.S.C. 154(b) by 98 days.

(21) Appl. No.: 18/147,782

(22) Filed: Dec. 29, 2022

(65) Prior Publication Data

US 2024/0217700 A1 Jul. 4, 2024

(51) Int. Cl.
*B65D 6/18* (2006.01)

(52) U.S. Cl.
CPC ..... *B65D 11/1853* (2013.01)

(58) Field of Classification Search
CPC . B65D 11/22; B65D 11/1873; B65D 11/1866; B65D 11/186; B65D 11/1893; B65D 21/08; B65D 21/086
USPC ..... 206/505; 220/6
See application file for complete search history.

(56) References Cited

FOREIGN PATENT DOCUMENTS

TW M454366 U 6/2013

*Primary Examiner* — Anthony D Stashick
*Assistant Examiner* — Raven Collins
(74) *Attorney, Agent, or Firm* — Rosenberg, Klein & Lee

(57) ABSTRACT

A folding box is provided. The folding box includes a bottom plate, a two side plates opposite to each other, a front plate, and a rear plate combined with one another. While in use, the above plates are expanded to form a box for mounting different objects. While not in use, the above plates are folded for storage. During expansion or folding of the folding box, touch fasteners are used to adhere and fix the respective plates tightly. Thereby overall weight of the folding box is lighter and the folding box is capable of being folded for minimizing storage space occupied while not in use. After being folded, the folding box is positioned precisely, unable to be expanded freely. Therefore, the folding box is more convenient to use.

10 Claims, 10 Drawing Sheets

FOLDING BOX

BACKGROUND OF THE INVENTION

Field of the Invention

The present invention relates to a folding box, especially to a folding box which is not only having a lighter weight, but also foldable for minimizing storage space occupied while not in use. After being folded for storage, the folding box is positioned precisely, without being expanded freely. Thereby the folding box is more convenient to use.

Description of Related Art

People use various types of storage boxes for mounting different objects therein. Our living environment is a small place with so many people so that the storage boxes occupy too much space while not in use. People in the business have developed many types of folding boxes which are able to be expanded for mounting the objects therein while in use or folded while not in use for reduction of the space occupied.

Refer to Taiwanese Pat. Pub. No. M454366(U) "expandable and foldable storage box structure" is revealed and composed of a bottom base portion formed by two symmetrical plates connected by a shaft, a side-plate portion including front and rear side-plates, and left and right side-plates, and a top over plate having a corner connected with an outer side of the rear plate by a shaft. The two symmetrical plates can be expanded or folded by the shaft and a lug is arranged at each of two sides of a joint between the two symmetrical plates for being locked into a sliding slot arranged at scooter mat and able to reciprocate in the sliding slot. Both lower and lateral sides of the front and the rear side-plates are connected with the bottom base portion and the left and the right side-plates by shafts for being expanded or folded. The left and the right side-plates are respectively formed by two symmetrical left sub-plates and two symmetrical right sub-plates which are also expandable or foldable by shafts disposed on joints between the two symmetrical left sub-plates and the two symmetrical right sub-plates. The top cover plate can be pulled upward and then folded downward to form a top cover for covering an opening on top of the side-plate portion. The top cover can be fastened with the front side-plate by a lock.

Although the above expandable and foldable storage box can be folded for storage while not in use, the storage box is easy to expand freely after being folded due to poor positioning effect provided during folding process. Thus the storage box is extremely inconvenient to use for users.

Thus there is room for improvement and there is a need to provide a novel folding box which is more convenient to use.

SUMMARY OF THE INVENTION

Therefore, it is a primary object of the present invention to provide a folding box which is not only having a lighter weight, but also foldable for minimizing storage space occupied while not in use. After being folded for storage, the folding box is positioned precisely, without being expanded freely. Thereby the folding box is more convenient to use.

In order to achieve the above object, a folding box according to the present invention includes a bottom plate, two opposite side plates, a front plate, and a rear plate.

The bottom plate consists of a bottom-plate side extension piece extending from each of two lateral sides of the bottom plate, a bottom-plate rear extension piece connected with a rear end of the bottom plate, and a bottom-plate front extension piece extending from a front end of the bottom plate. A bottom-plate side fixing fastener and a bottom-plate folding fixing fastener are respectively disposed on an inner surface and an outer surface of the bottom-plate side extension piece. A bottom-plate rear fixing fastener is mounted to an inner surface of the bottom-plate rear extension piece while a bottom-plate front fixing fastener is disposed on an inner surface of the bottom-plate front extension piece.

The two side plates are disposed above the two lateral sides of the bottom plate correspondingly and each of the side plates is composed of a folding line which is located on a middle part of the side plate and allowing the side plate to be folded along, a side-plate side fixing fastener disposed on the side plate and capable of being adhered to and connected with the bottom-plate side fixing fastener of the bottom-plate side extension piece correspondingly to form a box, a side-plate front extension piece extending from a front end of each of the two side plates and the two side-plate front extension pieces bent toward each other, and a side-plate rear extension piece extending from a rear end of each of the two side plates and the two side-plate rear extension pieces bent toward each other. A front support rod is disposed on top ends of the two side-plate front extension pieces for connection therebetween while a side-plate front fixing fastener is arranged at an outer side of an outer surface of each of the side-plate front extension pieces and a front pivot part is set at a bottom end of each of the two side-plate front extension pieces for pivotally connecting the side-plate front extension piece with the bottom-plate front extension piece of the bottom plate, and the bottom-plate front fixing fastener and the side-plate front fixing fastener are capable of being adhered and connected with each other. A rear support rod is disposed on top ends of the two side-plate rear extension pieces for connection therebetween.

The front plate includes a plurality of front support pieces able to be folded for storage, and a front-plate side fixing fastener mounted on each of two sides of a back surface of the front plate and capable of being adhered to and connected with the side-plate front fixing fastener of the side-plate front extension piece.

A rear-plate bottom fixing fastener is disposed on a bottom edge of a back surface of the rear plate and capable of being adhered to and connected with the bottom-plate rear fixing fastener of the bottom-plate rear extension piece of the bottom plate. Two rear-plate folding fixing fasteners arranged at two sides of the back surface of the rear plate correspondingly and capable of being adhered to and connected with the bottom-plate folding fixing fasteners of the bottom-plate side extension pieces during folding.

Preferably, the bottom-plate side extension piece and the bottom-plate side fixing fastener, the bottom-plate side extension piece and the bottom-plate folding fixing fastener, the bottom-plate rear extension piece and the bottom-plate rear fixing fastener, the side plate and the side-plate side fixing fastener, the side-plate front extension piece and the side-plate front fixing fastener, the bottom-plate front extension piece and the bottom-plate front fixing fastener, the two sides of the back surface of the front plate and the front-plate side fixing fasteners, the rear plate and the rear-plate bottom fixing fastener, and the two sides of the back surface of the rear plate and the rear-plate folding fixing fasteners are fixed and connected with each other by sewing, adhesion, or riveting.

Preferably, the bottom-plate front extension piece of the bottom plate and the front plate are integrally formed.

Preferably, a bottom-plate front connecting fastener is disposed on an outer surface of the bottom-plate front extension piece while a front-plate bottom connecting fastener is arranged at the back surface of a lower end of the front plate and capable of being adhered to and connected with the bottom-plate front connecting fastener of the bottom-plate front extension piece.

Preferably, the bottom-plate front extension piece and the bottom-plate front connecting fastener, the back surface of the lower end of the front plate and the front-plate bottom connecting fastener are both connected by sewing, adhesion, or riveting.

Preferably, at least one side pulling hole is mounted to the side plate and located over the side-plate side fixing fastener so that users can apply a force to pull the side pulling hole for adhering and connecting the side-plate side fixing fastener with the bottom-plate side fixing fastener firmly.

Preferably, a side-plate rear fixing fastener is mounted to an outer side of an outer surface of the side-plate rear extension piece while the rear plate is composed of a plurality of rear support pieces connected with one another and able to be folded for storage. A rear-plate side fixing fastener is arranged at each of two sides of a front surface of the rear plate and capable of being adhered to and connected with the side-plate rear fixing fastener of the side-plate rear extension piece.

Preferably, the side-plate rear extension piece and the side-plate rear fixing fastener, the two sides of the front surface of the rear plate and the rear-plate side fixing fasteners are fixed and connected by sewing, adhesion, and riveting.

Preferably, a rear pivot part is set on a bottom end of each of the two side-plate rear extension pieces for pivotally connected with a bottom edge of the rear plate.

Preferably, at least one rear pulling hole is mounted to the rear plate and located over the rear-plate bottom fixing fastener so that users can apply a force to pull the rear pulling hole for adhering and connecting the rear-plate bottom fixing fastener with the bottom-plate rear fixing fastener tightly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
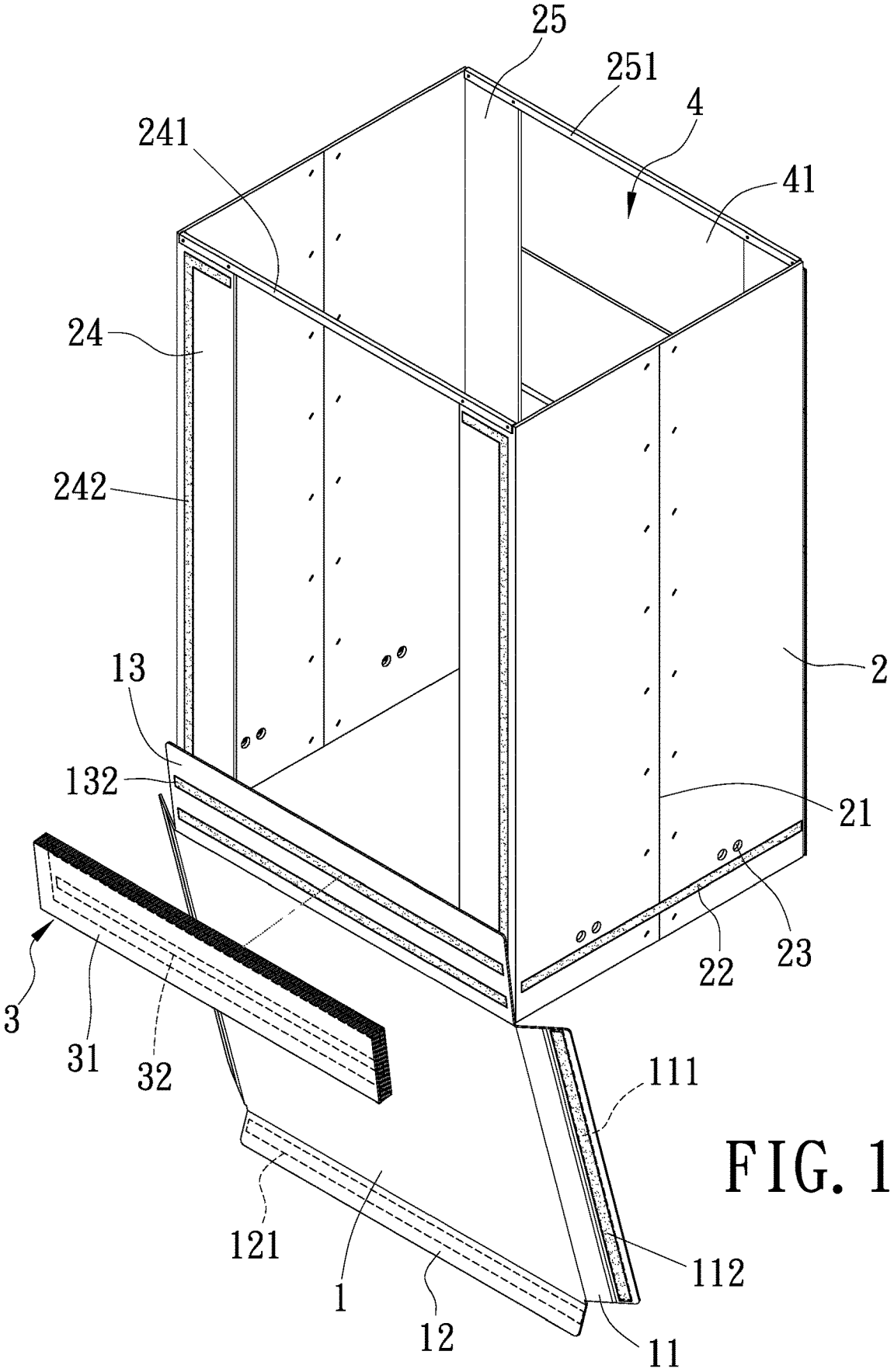
FIG. 1 is an exploded view of an embodiment according to the present invention.
Figure 2:
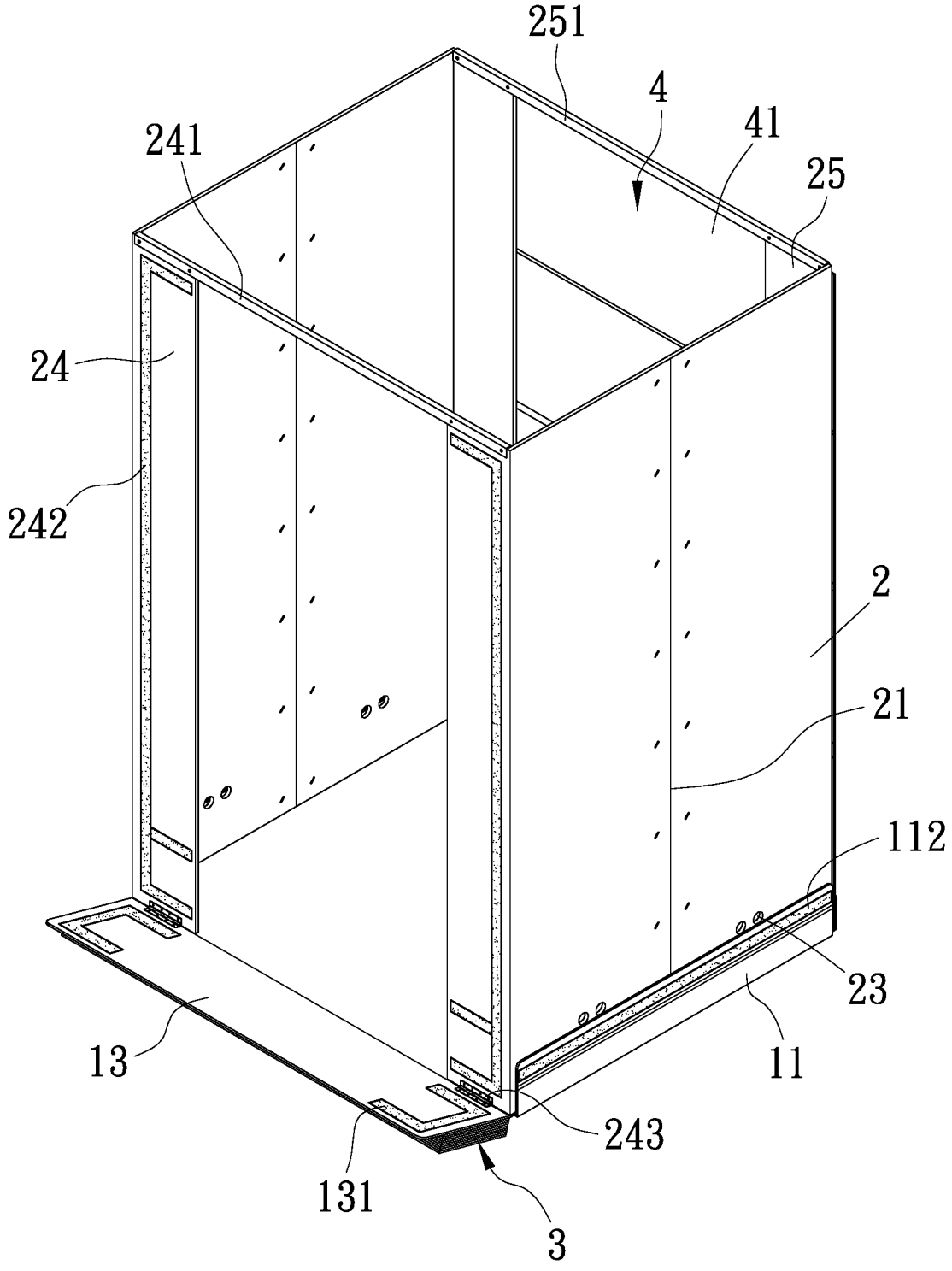
FIG. 2 is a perspective view showing a completely opened front plate of an embodiment according to the present invention.
Figure 3:
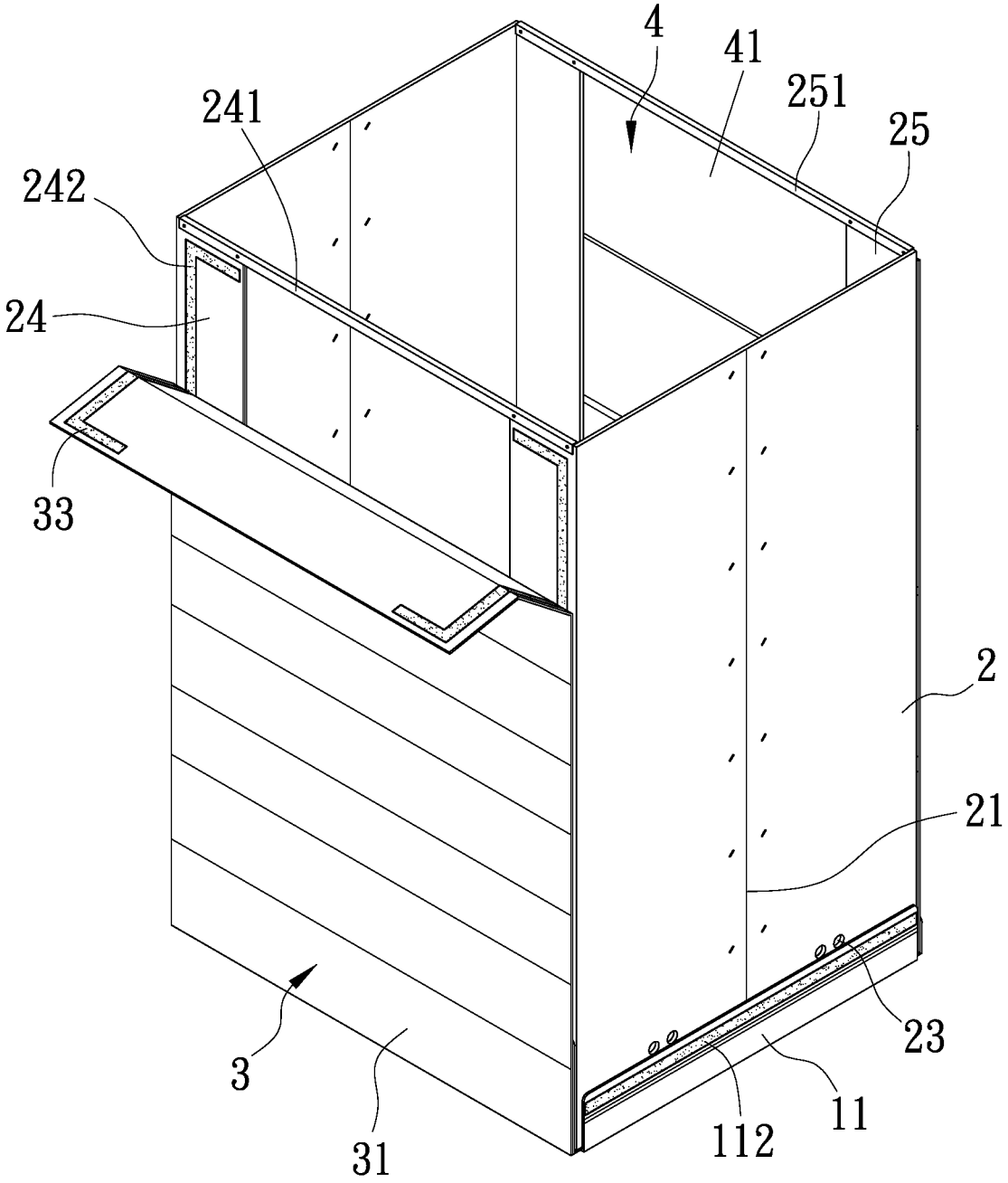
FIG. 3 is a perspective view showing a partially opened front plate of an embodiment according to the present invention.
Figure 4:
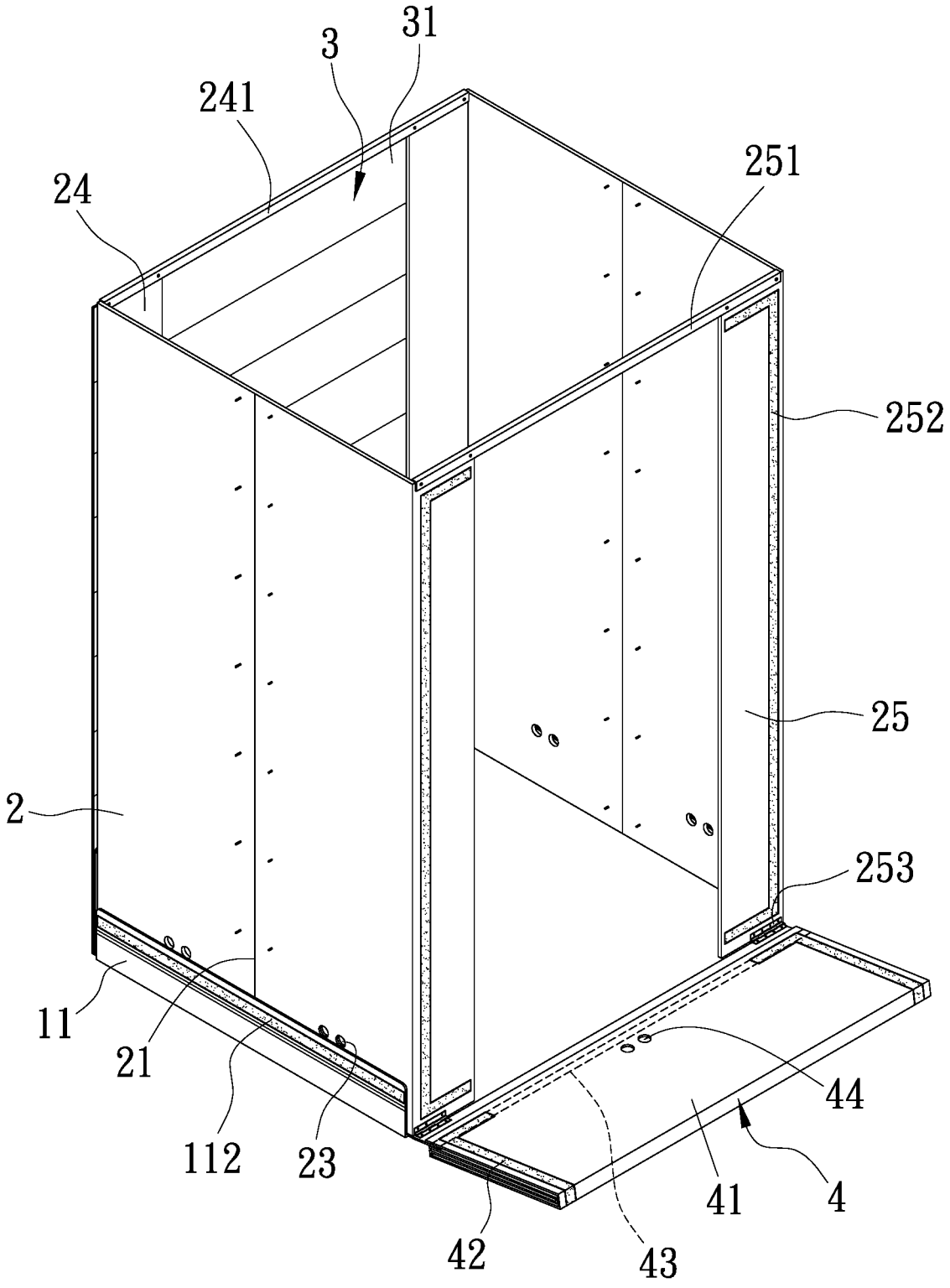
FIG. 4 is a perspective view showing a completely opened rear plate of an embodiment according to the present invention.
Figure 5:
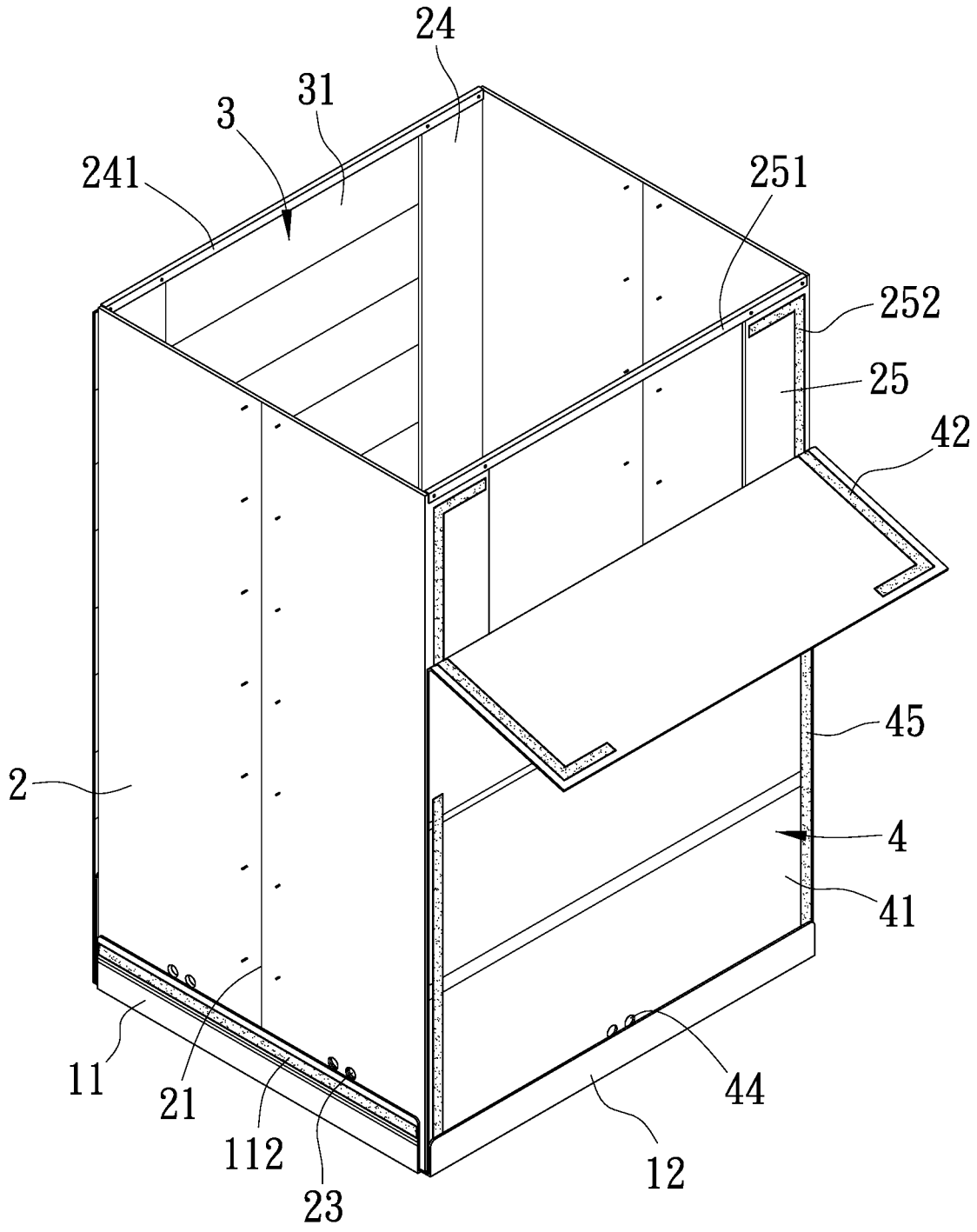
FIG. 5 is a perspective view showing a partially opened rear plate of an embodiment according to the present invention.

In order to learn technical content, purposes and functions of the present invention more clearly and completely, please refer to the following detailed descriptions with the figures and reference signs.

Refer to FIGS. 1-5, a foldable box according to the present invention mainly includes a bottom plate 1, two side plates 2 arranged opposite to each other, a front plate 3, and a rear plate 4.

The bottom plate 1 consists of a bottom-plate side extension piece 11 extending from each of two lateral sides of the bottom plate 1, a bottom-plate rear extension piece 12 extending from a rear end of the bottom plate 1, and a bottom-plate front extension piece 13 extending from a front end of the bottom plate 1. The term "fastener" hereinafter is referred to as hook-and-loop fastener or touch fastener (brand name, Velcro). A bottom-plate side fixing fastener 111 and a bottom-plate folding fixing fastener 112 are respectively disposed on an inner surface and an outer surface of the bottom-plate side extension piece 11 by sewing, adhesion, or riveting. Similarly, a bottom-plate rear fixing fastener 121 is mounted to an inner surface of the bottom-plate rear extension piece 12 by sewing, adhesion, or riveting while a bottom-plate front fixing fastener 131 and a bottom-plate front connecting fastener 132 are respectively disposed on an inner surface and an outer surface of the bottom-plate front extension piece 13 by sewing, adhesion, or riveting.

The two side plates 2 are disposed above the two lateral sides of the bottom plate 1 correspondingly and each of the side plates 2 is composed of a folding line 21 which is located on a middle part thereof and allowing the side plate 2 to be folded along, a side-plate side fixing fastener 22 disposed on the side plate 2 by sewing, adhesion, or riveting and capable of adhered to and connected with the bottom-plate side fixing fastener 111 of the bottom-plate side extension piece 11 correspondingly, a plurality of side pulling holes 23 mounted over the side-plate side fixing fastener 22, a side-plate front extension piece 24 extending from a front end of each of the two side plates 2 and the two side-plate front extension pieces 24 bent toward each other, and a side-plate rear extension piece 25 extending from a rear end of each of the two side plates 2 and the two side-plate rear extension pieces 25 bent toward each other. During adhesion and connection between the side-plate side fixing fastener 22 and the bottom-plate side fixing fastener 111, users can apply a force to pull the side pulling holes 23 for adhering and connecting the side-plate side fixing fastener 22 with the bottom-plate side fixing fastener 111 tightly. A front support rod 241 is disposed on and connected with top ends of the two side-plate front extension pieces 24 for connecting the two side-plate front extension pieces 24 while a side-plate front fixing fastener 242 is disposed on an outer side of an outer surface of the side-plate front extension pieces 24 by sewing, adhesion, or riveting and a front pivot part 243 is arranged at a bottom end of each of the two side-plate front extension pieces 24 for pivotally connecting the side-plate front extension pieces 24 with the bottom-plate front extension piece 13 of the bottom plate 1. At the same time, the bottom-plate front fixing fastener 131 and the side-plate front fixing fastener 242 are capable of being adhered and connected with each other. The side-plate rear extension piece 25 is composed of a rear support rod 251 disposed on and connected with top ends of the two side-plate rear extension piece 25 for connecting the two side-plate rear extension pieces 25, a side-plate rear fixing fastener 252 mounted to an outer side of an outer surface of each of the side-plate rear extension pieces 25 by sewing, adhesion, or riveting, and a rear pivot part 253 set on a bottom end of each of the side-plate rear extension pieces 25.

The front plate 3 includes a plurality of front support pieces 31 connected with one another and able to be folded for storage, a front-plate bottom connecting fastener 32 arranged at a back surface of a lower end thereof by sewing, adhesion, or riveting and capable of being adhered to and connected with the bottom-plate front connecting fastener 132 of the bottom-plate front extension piece 13, and a front-plate side fixing fastener 33 set on each of two sides of the back surface thereof by sewing, adhesion, or riveting and capable of being adhered to and connected with the side-plate front fixing fastener 242 of the side-plate front extension piece 24.

The rear plate 4 includes a plurality of rear support pieces 41 connected with one another and able to be folded for storage, a rear-plate side fixing fastener 42 arranged at each of two sides of a front surface thereof by sewing, adhesion, or riveting and capable of being adhered to and connected with the side-plate rear fixing fastener 252 of each of the side-plate rear extension pieces 25, a rear-plate bottom fixing fastener 43 disposed on a bottom edge of a back surface of the rear plate 4 by sewing, adhesion, or riveting and capable of being adhered to and connected with the bottom-plate rear fixing fastener 121 of the bottom-plate rear extension piece 12, two rear pulling holes 44 mounted over the rear-plate bottom fixing fastener 43, two rear-plate folding fixing fasteners 45 disposed on two sides of the back surface of the rear plate 4 by sewing, adhesion, or riveting and capable of being adhered to and connected with the bottom-plate folding fixing fasteners 112 of the bottom-plate side extension piece 11. A bottom edge of the rear plate 4 is pivotally connected with the rear pivot parts 253 of the side-plate rear extension pieces 25 of the side plates 2. During adhesion and connection between the rear-plate bottom fixing fastener 43 and the bottom-plate rear fixing fastener 121, users can apply a force to pull the rear pulling holes 44 for adhering and connecting the rear-plate bottom fixing fastener 43 with the bottom-plate rear fixing fastener 121 tightly.

Figure 6:
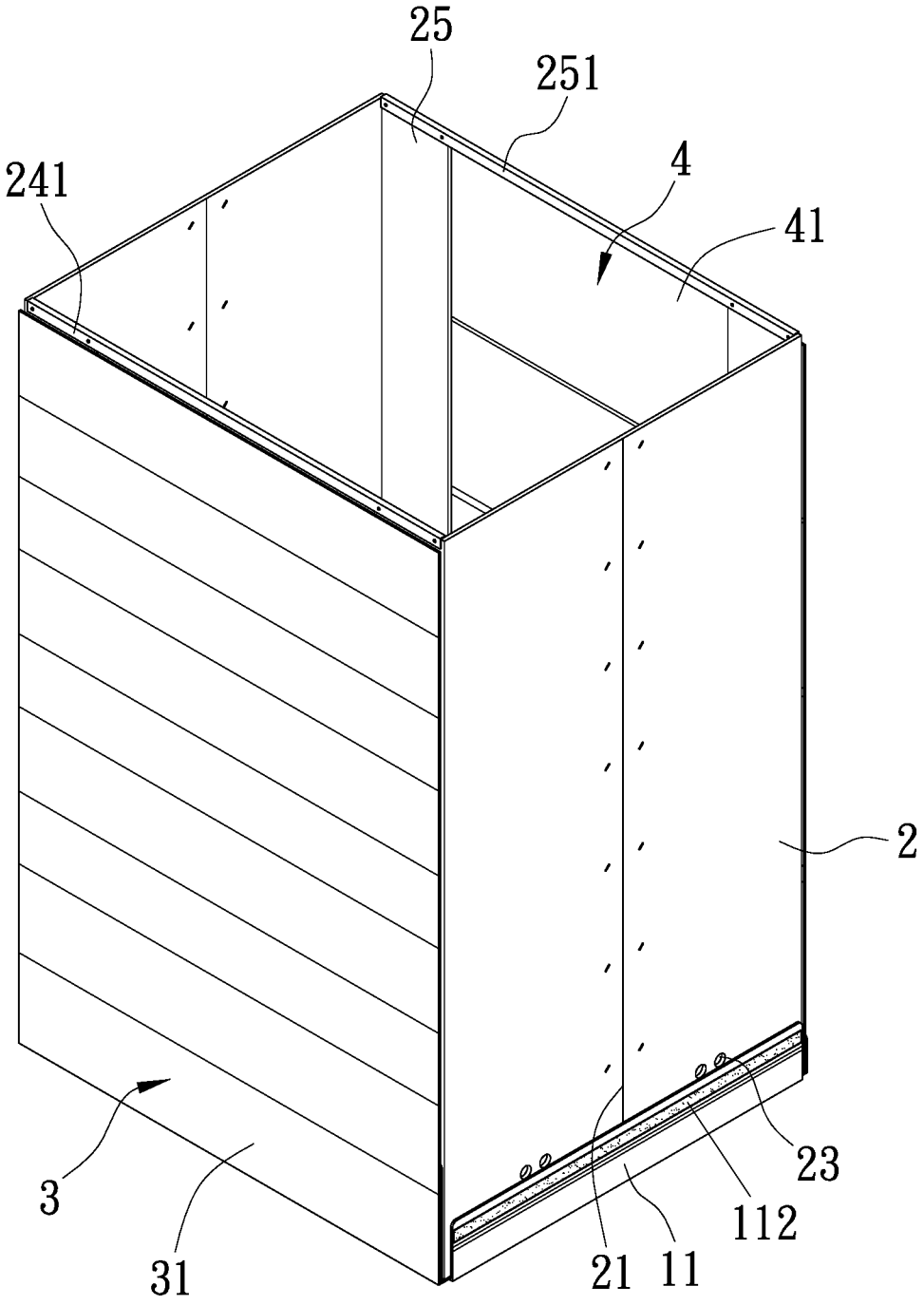
FIG. 6 is a perspective view of an embodiment according to the present invention.

Refer to FIG. 6, while in use, the folding box of the present invention is expanded. First, the side plates 2 are expanded and the bottom-plate side fixing fastener 111 of the bottom-plate side extension piece 11 on each of the two lateral sides of the bottom plate 1 is adhered to and connected with the side-plate side fixing fastener 22 of the side plate 2. After the respective front support pieces 31 of the front plate 3 being expanded completely, not only the front-plate side fixing fastener 33 of the front plate 3 is adhered to and connected with the side-plate front fixing fastener 242 of the side-plate front extension pieces 24, the bottom-plate front connecting fastener 132 of the bottom-plate front extension piece 13 is also adhered to and connected with the front-plate bottom connecting fastener 32 of the front plate 3. The rear support pieces 41 of the rear plate 4 are also expanded completely. Next the rear-plate side fixing fastener 42 of the rear plate 4 and the side-plate rear fixing fastener 252 of the side-plate rear extension pieces 25 are adhered to and connected with each other. The bottom-plate rear fixing fastener 121 of the bottom-plate rear extension piece 12 and the rear-plate bottom fixing fastener 43 of the rear plate 4 are also adherer to and connected with each other. Thereby objects users intend to mount can be placed into a space formed among the bottom plate 1, the two side plates 2, the front plate 3, and the rear plate 4. When the user wants to take the objects in the folding box out, the respective front support pieces 31 of the front plate 3 are disconnected from top to bottom in turn and then folded from top to bottom. Therefore, the objects mounted in the folding box are taken out from top to bottom in turn.

Figure 7:
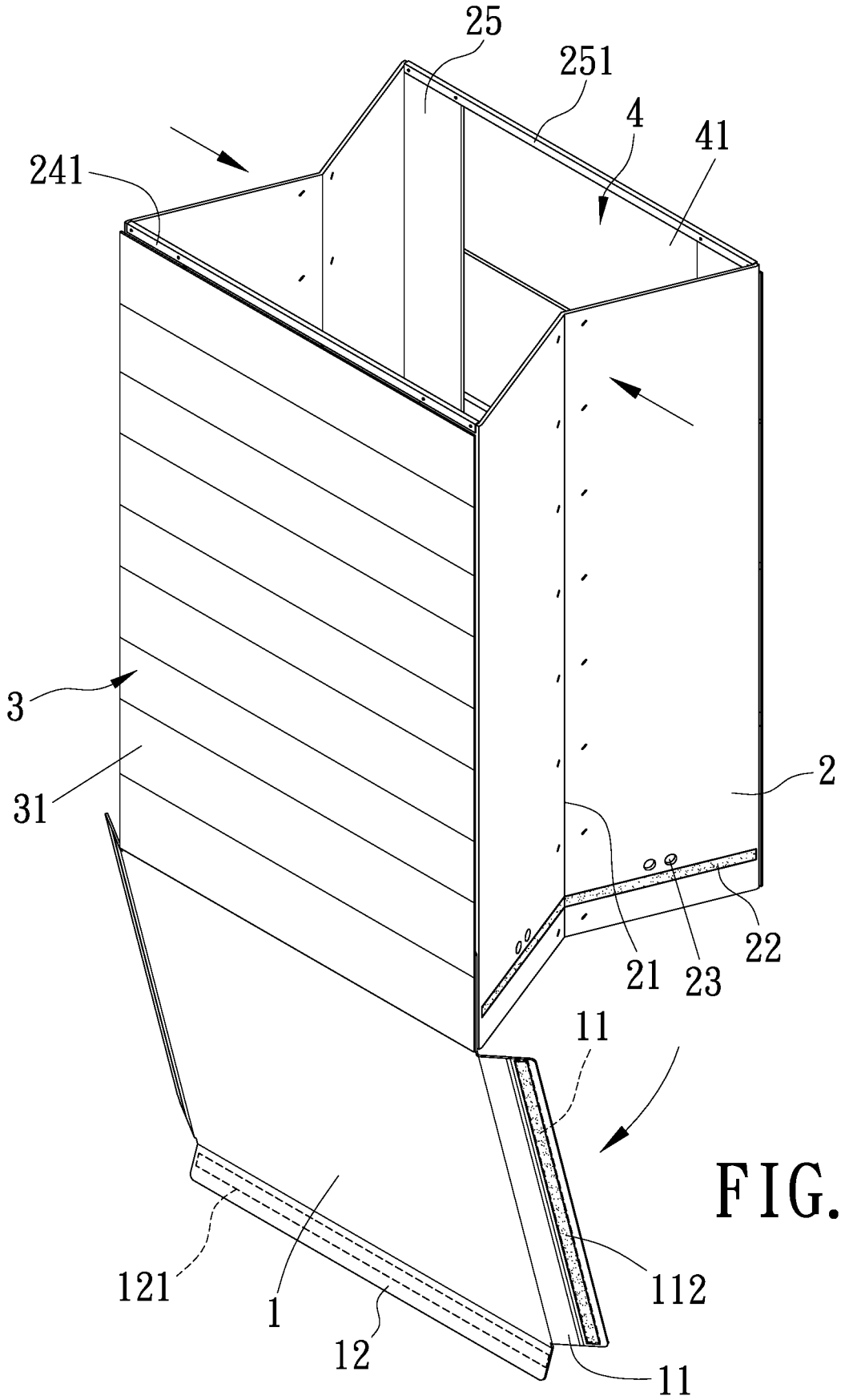
FIG. 7 is a schematic drawing showing an embodiment being folded for storage according to the present invention.
Figure 8:
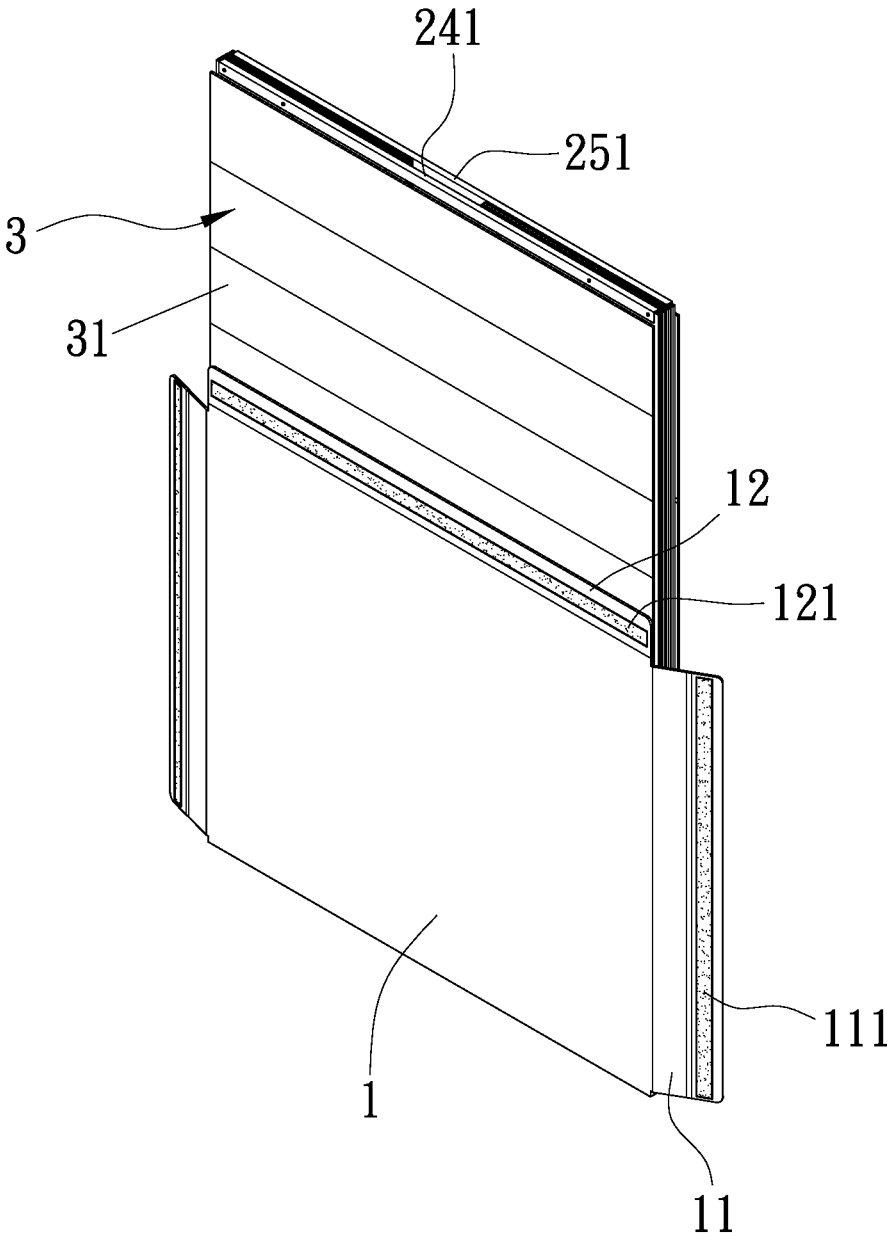
FIG. 8 is another schematic drawing showing an embodiment being folded for storage according to the present invention.
Figure 9:
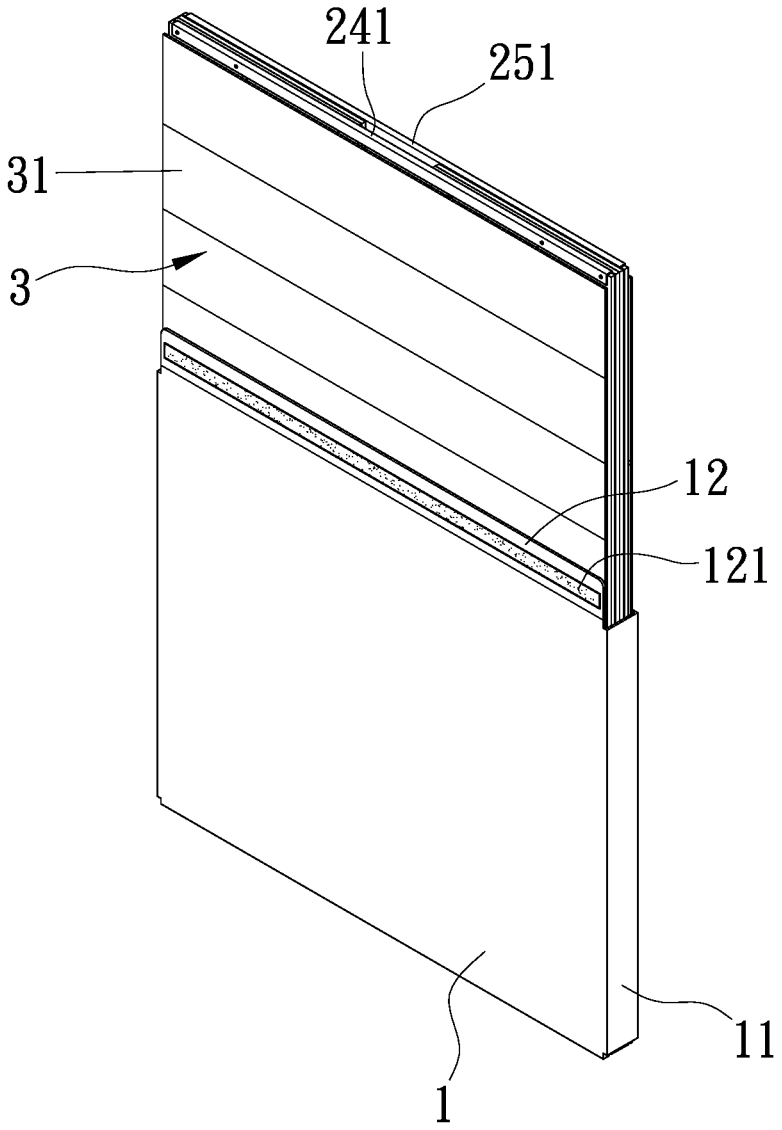
FIG. 9 is a schematic drawing showing an embodiment in a folded state according to the present invention.
Figure 10:
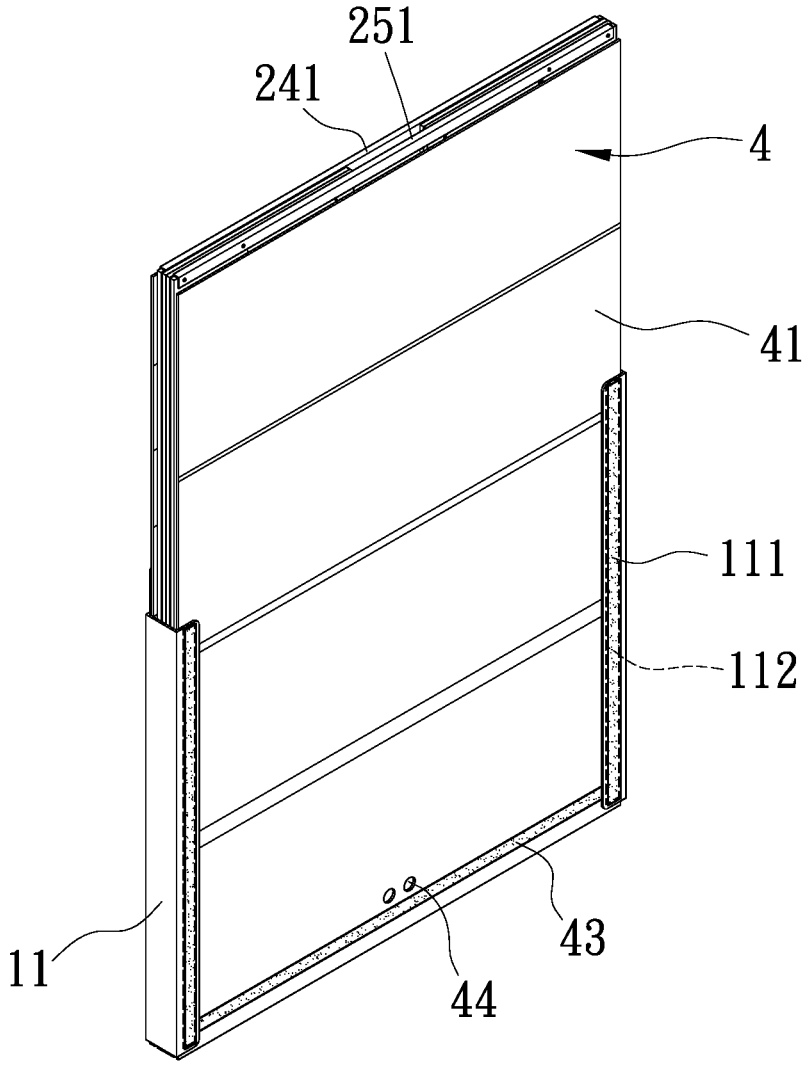
FIG. 10 is a schematic drawing showing an embodiment in a folded state viewed from another angle according to the present invention.

While not in use, refer to FIG. 7-10, the front-plate side fixing fastener 33 of the front plate 3 and the side-plate front fixing fastener 242 of the side-plate front extension pieces 24 are adhered to and connected with each other, and so are the rear-plate side fixing fastener 42 of the rear plate 4 and the side-plate rear fixing fastener 252 of the side-plate rear extension pieces 25. Then not only the bottom-plate side fixing fastener 111 of the bottom-plate side extension piece 11 and the side-plate side fixing fastener 22 of the side plate 2 are separated from each other, the bottom-plate rear fixing fastener 121 of the bottom-plate rear extension piece 12 and the rear-plate bottom fixing fastener 43 of the rear plate 4 are also separated. Next the bottom plate 1 is bent toward a front surface of the front plate 3 while both the two side plates 2 are folded inward along the folding lines 21 at the middle part thereof, as shown in FIG. 7. Thus the bottom plate 1, the two side plates 2, the front plate 3, and the rear plate 4 are folded and overlapped into a flat form, as shown in FIG. 8. Then the bottom-plate folding fixing fasteners 112 of the bottom-plate side extension piece 11 and the rear-plate folding fixing fasteners 45 disposed on two sides of the back surface of the rear plate 4 are adhered to and connected with each other. Thereby the bottom plate 1, the two side plates 2, the front plate 3, and the rear plate 4 are folded, overlapped, and fixed, as shown in FIG. 9 and FIG. 10.

In summary, compared with the techniques available now, the present invention has the following advantages. The weight of the whole folding box is lighter. While not in use, the folding box is folded for storage and space occupied is minimized. After being folded for storage, the folding box is positioned precisely, unable to be expanded freely. Thereby the folding box is more convenient to use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A folding box comprising a bottom plate, two opposite side plates, a front plate, and a rear plate;

wherein the bottom plate includes a bottom-plate side extension piece which is extending from each of two lateral sides of the bottom plate and provided with a bottom-plate side fixing fastener and a bottom-plate folding fixing fastener respectively disposed on an inner surface and an outer surface of the bottom-plate side extension piece;

a bottom-plate rear extension piece extending from a rear end of the bottom plate and provided with a bottom-plate rear fixing fastener disposed on an inner surface of the bottom-plate rear extension piece; and a bottom-plate front extension piece extending from a front end of the bottom plate and having a bottom-plate front fixing fastener disposed on an inner surface of the bottom-plate front extension piece;

wherein the two side plates are disposed above the two lateral sides of the bottom plate correspondingly and each of the side plates having a folding line which is located on a middle part of the side plate and allowing the side plate to be folded along, a side-plate side fixing fastener disposed on the side plate and capable of being adhered to and connected with the bottom-plate side fixing fastener of the bottom-plate side extension piece correspondingly to form a box, a side-plate front extension piece extending from a front end of each of the two side plates and the two side-plate front extension pieces bent toward each other; wherein a front support rod is disposed on top ends of the two side-plate front extension pieces for connection therebetween while a side-plate front fixing fastener is arranged at an outer side of an outer surface of the side-plate front extension piece and a front pivot part is set at a bottom end of each of the two side-plate front extension pieces for pivotally connecting the side-plate front extension piece with the bottom-plate front extension piece of the bottom plate, and the bottom-plate front fixing fastener and the side-plate front fixing fastener are capable of being adhered and connected with each other; and a side-plate rear extension piece extending from a rear end of each of the two side plates and the two side-plate rear extension pieces bent toward each other while a rear support rod disposed on top ends of the two side-plate rear extension pieces for connection therebetween;

wherein the front plate includes a plurality of front support pieces able to be folded for storage, and a front-plate side fixing fastener mounted on each of two sides of a back surface of the front plate and capable of being adhered to and connected with the side-plate front fixing fastener of the side-plate front extension piece; and wherein the rear plate is provided with a rear-plate bottom fixing fastener disposed on a bottom edge of a back surface of the rear plate and capable of being adhered to and connected with the bottom-plate rear fixing fastener of the bottom-plate rear extension piece of the bottom plate, and two rear-plate folding fixing fasteners arranged at two sides of the back surface of the rear plate correspondingly and capable of being adhered to and connected with the bottom-plate folding fixing fasteners of the bottom-plate side extension pieces during folding.

2. The folding box as claimed in claim 1, wherein the bottom-plate side extension piece and the bottom-plate side fixing fastener, the bottom-plate side extension piece and the bottom-plate folding fixing fastener, the bottom-plate rear extension piece and the bottom-plate rear fixing fastener, the side plate and the side-plate side fixing fastener, the side-plate front extension piece and the side-plate front fixing fastener, the bottom-plate front extension piece and the bottom-plate front fixing fastener, the two sides of the back surface of the front plate and the front-plate side fixing fasteners, the rear plate and the rear-plate bottom fixing fastener, and the two sides of the back surface of the rear plate and the rear-plate folding fixing fasteners are fixed and connected with each other by a method selected from the group consisting of sewing, adhesion, and riveting.

3. The folding box as claimed in claim 1, wherein the bottom-plate front extension piece of the bottom plate and the front plate are integrally formed.

4. The folding box as claimed in claim 1, wherein a bottom-plate front connecting fastener is disposed on an outer surface of the bottom-plate front extension piece while a front-plate bottom connecting fastener is arranged at the back surface of a lower end of the front plate and capable of being adhered to and connected with the bottom-plate front connecting fastener of the bottom-plate front extension piece.

5. The folding box as claimed in claim 4, wherein the bottom-plate front extension piece and the bottom-plate front connecting fastener, the back surface of the lower end of the front plate and the front-plate bottom connecting fastener are both fixed and connected with each other by a method selected from the group consisting of sewing, adhesion, or riveting.

6. The folding box as claimed in claim 1, wherein at least one side pulling hole is mounted to the side plate and located over the side-plate side fixing fastener so that a force is applied to pull the side pulling hole for adhering and connecting the side-plate side fixing fastener with the bottom-plate side fixing fastener firmly.

7. The folding box as claimed in claim 1, wherein a side-plate rear fixing fastener is mounted to an outer side of an outer surface of the side-plate rear extension piece while the rear plate is composed of a plurality of rear support pieces connected with one another and able to be folded for storage; a rear-plate side fixing fastener is arranged at each of two sides of a front surface of the rear plate and capable of being adhered to and connected with the side-plate rear fixing fastener of the side-plate rear extension piece.

8. The folding box as claimed in claim 7, wherein the side-plate rear extension piece and the side-plate rear fixing fastener, the two sides of the front surface of the rear plate and the rear-plate side fixing fasteners are both fixed and connected with each other by a method selected from the group consisting of sewing, adhesion, and riveting.

9. The folding box as claimed in claim 7, wherein a rear pivot part is set on a bottom end of each of the two side-plate rear extension pieces for pivotally connected with a bottom edge of the rear plate.

10. The folding box as claimed in claim 7, wherein at least one rear pulling hole is mounted to the rear plate and located over the rear-plate bottom fixing fastener so that a force is applied to pull the rear pulling hole for adhering and connecting the rear-plate bottom fixing fastener with the bottom-plate rear fixing fastener tightly.

* * * * *